United States Patent [19]

Darling et al.

[11] Patent Number: 4,470,225

[45] Date of Patent: Sep. 11, 1984

[54] VARIABLE POSITION ORBITAL SANDER

[75] Inventors: Robert P. Darling, Stonybrook; Leonard J. Ober, Hicksville, both of N.Y.

[73] Assignee: Grumman Aerospace Corporation, Bethpage, N.Y.

[21] Appl. No.: 571,289

[22] Filed: Jan. 16, 1984

Related U.S. Application Data

[63] Continuation of Ser. No. 287,481, Jul. 27, 1981, abandoned.

[51] Int. Cl.[3] ..... B24B 5/38

[52] U.S. Cl. ..... 51/147; 51/90; 51/241 B; 51/289 R; 144/4; 409/74; 74/674; 74/682; 15/88; 15/104.04

[58] Field of Search ..... 51/90, 135 R, 145 R, 51/147, 241 B, 289 R, 43; 15/104.04, 104.05, 104.09, 104.13, 88; 74/660, 674, 679, 682, 785; 144/4; 175/173, 202; 299/80; 408/12; 409/74, 199, 200

[56] References Cited

U.S. PATENT DOCUMENTS

| | | | |
|---|---|---|---|
| 725,266 | 4/1903 | Merritt | 51/90 X |
| 1,215,482 | 2/1917 | Chamberlain | 51/90 |
| 2,165,118 | 7/1939 | White | 51/90 X |
| 2,181,285 | 11/1939 | Schuler | 51/90 |
| 3,093,170 | 6/1963 | Thayer | 51/148 X |
| 3,304,661 | 2/1967 | Maguire | 51/90 |
| 3,432,971 | 3/1969 | Conti | 51/90 X |
| 3,436,988 | 4/1969 | Simonton | 74/837 |
| 3,469,886 | 9/1969 | Marberg | 299/80 |
| 3,596,409 | 8/1971 | Lesesley | 51/135 R |

*Primary Examiner*—Robert P. Olszewski

*Attorney, Agent, or Firm*—John P. Kozma; Richard G. Geib; Daniel J. Tick

[57] ABSTRACT

A machine which orbits an abrader or cleaning tool about a fixed axis at a relatively low speed in which the orbital radius of the abrader may be changed while the machine is in operation.

8 Claims, 6 Drawing Figures

VARIABLE POSITION ORBITAL SANDER

This application is a continuation of application Ser. No. 287,481, filed 7/27/81 now abandoned.

BACKGROUND

This invention relates to a tool capable of finishing the periphery of an object.

Many machines in the current art are designed to rotate an abrasive belt or wire brush about a fixed axis at a relatively low speed while driving the tool about its own axis at a much higher speed. Such a tool will present the outside surface of an object centered around the fixed axis to a rapidly moving finishing surface which evenly covers all points on the object's periphery.

An early version of such a machine described in U.S. Pat. No. 799,422, issued to Bornman, includes a pair of abrading belts which are bolted in place prior to operation. The Bornman tool employs a feed unit to allow continuous sanding operations, but changes in abrading pressure while the machine is running are not possible.

U.S. Pat. No. 1,215,482, issued to Chamberlain, describes a cleaning machine employing a pair of rotating brushes. The Chamberlain machine may be operated in one mode to clean flat stock, wherein the cleaning brushes rotate about their own axis in a stationary orbital position, or in a second mode in which the brushes orbit about the axis of a round stock. In either mode, however, the brushes must be present prior to operation.

The problem of providing on operation adjustment of abrading pressure is met to some extent by U.S. Pat. No. 3,071,903, issued to Wing, et al. In the Wing device two continuous belts are moved toward the workpiece by flyweights as the orbital velocity of the belts is increased. Belt pressure is, however, a function of the orbital velocity, and cannot be regulated unless a variable speed motor is used.

Still another machine in the present art, described in U.S. Pat. No. 3,526,060, issued to Hall, et al, provides a threaded shaft for adjustment to accommodate various sized workpieces without altering the orbital velocity of the abrader. Again, however, on operation adjustment is not possible.

It would be of considerable advantage, therefore to provide an orbital abrader in which the orbital radius can be varied during the abrading operation. Such a machine would allow adjustments for variations among objects to be operated on by the abrader without the necessity of stopping the machine for each such adjustment. Various abrading operations, such as sanding oversized tube ends for correct fit in joints to be brazed, finishing the tube ends prior to assembly cryogenic fittings to eliminate minor extrusion scratch paths, deburring tubing, shaping, etc., would be greatly expedited by such a machine.

SUMMARY OF THE INVENTION

It is, therefore, a primary object of the present invention to provide a machine for finishing the outside surfaces of objects which machine is capable of manual or automatic adjustment for the size of the object and abrading pressure to be applied to the surface thereof while the machine is in operation.

It is one further object of the present invention to provide a machine having an abrasive head with rotary motion about its own axis and, at the same time, orbital motion about a fixed axis, with a single power source.

Yet a further object of the present invention is to provide a machine capable of infinite adjustment for size variances among objects to be finished and abrading pressures to be applied for finishing the outside surface of objects.

A still further object of the present invention is to provide a machine capable of finishing the outside surface of an object along any portion of its length.

In accordance with the objects and design of the present invention, a machine is provided with a single drive shaft which, through independent linkages, drives a mounting wheel and a tracking element at equal angular velocities. The mounting wheel carries an abrasive belt and provides the belt with orbital motion about a fixed axis and at the same time imparts rotation to the belt itself. The tracking means is linked to a handle or other means with which the operator controls the position of an operative portion of the belt with respect to the fixed orbital axis. Changing the belt position allows the machine to accommodate for various sizes of objects to be finished as well as changing the abrading pressure.

BRIEF DESCRIPTION OF THE DRAWINGS

These objects together with other features and advantages of the present invention will become apparent in the following description of a preferred embodiment, a better understanding of which may be had by reference to the drawings, in which.

DETAILED DESCRIPTION OF PREFERRED EMBODIMENTS

A. Construction

Figure 1:
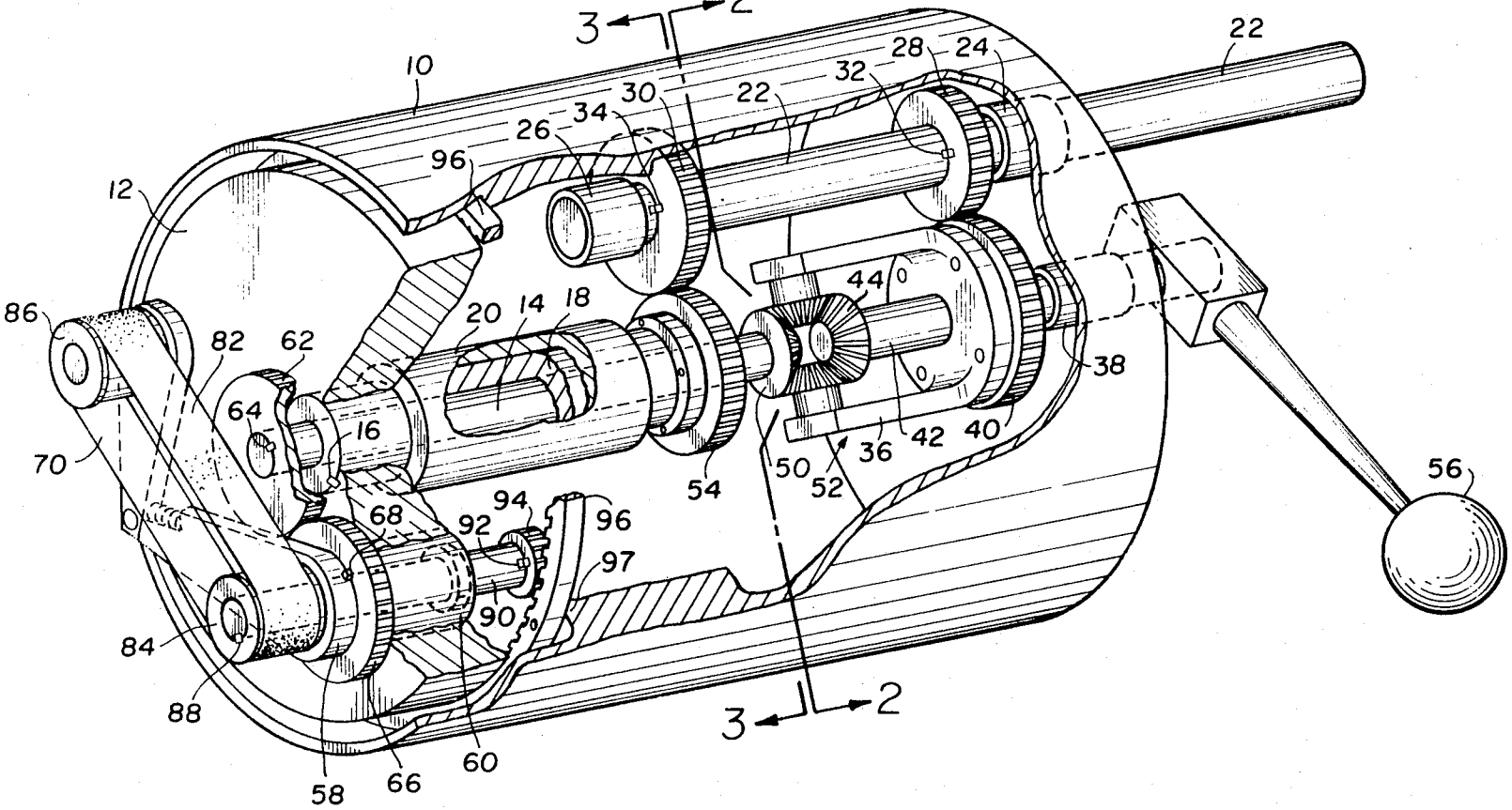
FIG. 1 is a partially cut away isometric view of a first embodiment of the present invention.
Figure 3:
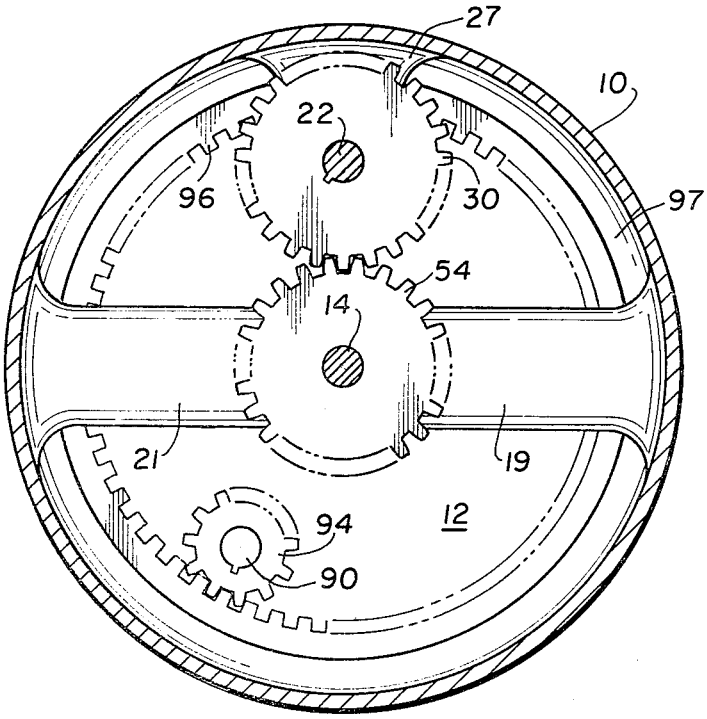
FIG. 3 is a sectional view of the FIG. 1 taken along lines 3—3.

Referring more specifically to FIG. 1, a stationary casing 10 serves to rotatably support a mounting wheel 12 and tracking means or inner shaft 14. Mounting wheel 12 is keyed, as at 16, to an outer shaft 18 which is rotatably mounted to casing 10 as by bearing 20 and struts 19 and 21 (FIG. 3). Inner shaft 14 is rotatably disposed within outer shaft 18 such that a rotational axis of the inner shaft is aligned with a rotational axis of the mounting wheel.

Figure 2:
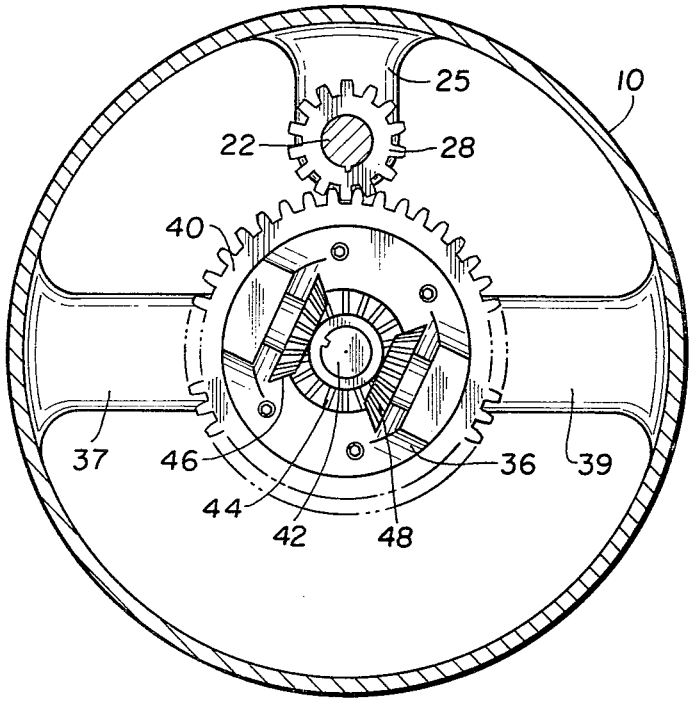
FIG. 2 is a sectional view of the FIG. 1 taken along lines 2—2.

A drive shaft 22 is rotatably mounted to the casing 10 as by bearings 24 and 26 (FIG. 1) and shoulders 25 and 27 (FIGS. 2 & 3). First and second drive gears 28 and 30 are mounted on drive shaft 22 to be rotatable therewith, as by keys 32 and 34. A drive means, not shown, may be connected to the drive shaft externally of casing 10.

Unless otherwise specified, all gears named descriptively in the present specification, such as first and second drive gears, are spur gears. Of course, one skilled in the art will recognize that torque transmission means alternative to meshing combinations of spur gears may be employed without departing from the spirit of the present invention. Such means in the present art might include, for example, drive belts, chains, clutches, etc.

Drive shaft 22 has a rotational axis parallel to those of the mounting wheel 12 and inner shaft 14. A miter gear support 36 is rotatably mounted to the casing 10 as by bearing 38 and struts 37 and 39 (FIG. 2) such that its rotational axis is aligned with those of the mounting wheel 12 and inner shaft 14. A free gear 40 is mounted on the miter gear support 36 to be rotatable therewith and mesh with the first drive gear 28. An adjusting shaft 42 is rotatably disposed within miter gear support 36, and a first miter gear 44 is fixed to an end of the adjusting shaft to be rotatable therewith.

Miter gear support 36 serves to rotatably mount second and third miter gears 46 and 48 such that their rotational axes are aligned with each other and perpendicular to the rotational axis of the miter gear support itself (FIG. 2). Second and third miter gears 46 and 48 are equidistant from the rotational axis of the miter gear support 36 and mesh with first miter gear 44 on opposite sides thereof. A fourth miter gear 50 is fixed to an end of the inner shaft 14 to be rotatable therewith. Second and third miter gears 46 and 48 also mesh with fourth miter gear 50 on opposite sides thereof, thus forming a rotating square or planetary miter gear structure 52.

A mounting wheel gear 54 is fixed to an end of the outer shaft 18 to be rotatable therewith and mesh with second drive gear 30 (FIG. 3). The gear ratio between the second drive gear 30 and the mounting wheel gear 54 is chosen such that the mounting wheel 12 and the tracking means or inner shaft 14 rotate at an identical rotational velocity. Of course, the gear ratio between the first drive gear 28 and the free gear 40 or the gear ratios in the planetary miter gear arrangement 52 may be similarly determined to give a desired rotational velocity of the inner shaft 14.

A handle 56 is fixed externally of casing 10 to the end of adjusting shaft 42 opposite the first miter gear 44. One skilled in the art will appreciate that handle 56 may be replaced by an automatically controlled, as by a microprocessor, servo-motor means if non-manual operation is desired.

An arm 58 is pivotally mounted to mounting wheel 12, as by bearing 60, such that a pivotal axis of arm 58 is parallel to and spaced from the rotational axis of the mounting wheel. A tracking gear 62 is keyed, as at 64, to the end of inner shaft 14 opposite the fourth miter gear 50, and meshes with pivot gear 66, keyed at 68 to arm 58. Arm 58 serves to mount abrader means 70 having an operative portion 72 spaced from the arm's pivotal axis. Operative portion 72 may include pressure sensing means if automatic control means are used in place of handle 56.

Figure 4:
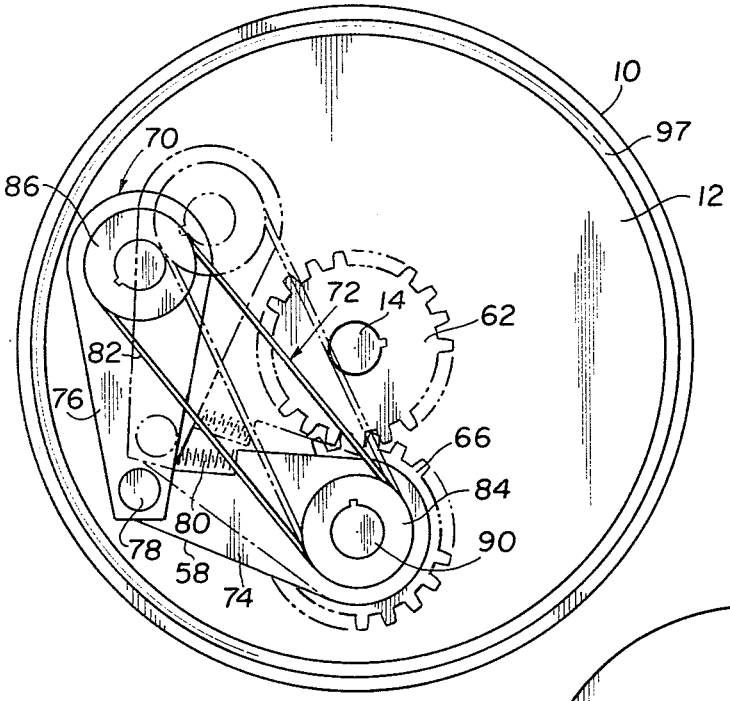
FIG. 4 is a front elevation view of FIG. 1 showing a pivotal motion of an abrader element.

As seen in FIG. 4, arm 58 comprises first and second legs 74 and 76 pivotally joined at 78. First leg 74 is pivotally mounted to the mounting wheel such that the pivotal axis of the arm is a pivotal axis of said first leg. Pivot 78 is spaced from the pivotal axis of arm 58. Leg 74 and 76 are biased apart arcuately as by compression spring 80.

The essential element of abrader means 70 is a continuous abrasive belt 82 which may include either chemically or mechanically abrasive material. While it will be appreciated by those skilled in the art that wire brushes, abrasive wheels or other abrader elements may be substituted for belt 82 as desired in various applications, the abrasive belt offers considerable versatility in that belts with abrasive materials of various grit sizes and grades are readily interchangeable. It may even be desirable to construct pivot arm 58 to be adaptable to both belts and other types of abrader elements. Also, plural abraders may be used to balance the mounting wheel, provide quicker material removal, or to provide successively finer finishes.

Belt 82 is positioned about drive wheel 84 and free wheel 86. Drive wheel 84 is keyed, as at 88, to a belt shaft 90 rotatably disposed within first leg 74 of arm 58. Belt shaft 90 has a rotational axis coincidental with the pivotal axis of arm 58. Free wheel 86 is rotatably mounted to second leg 76 of arm 58 such that a rotational axis of free wheel 86 is parallel to the rotational axis of belt shaft 90 and spaced from pivot 78.

To the end of belt shaft 90 opposite drive wheel 84 is keyed, as at 92, a belt shaft gear 94. An internal gear 96 is fixed to a lip 97 of the casing 10 to mesh with belt shaft gear 94.

Figure 5:
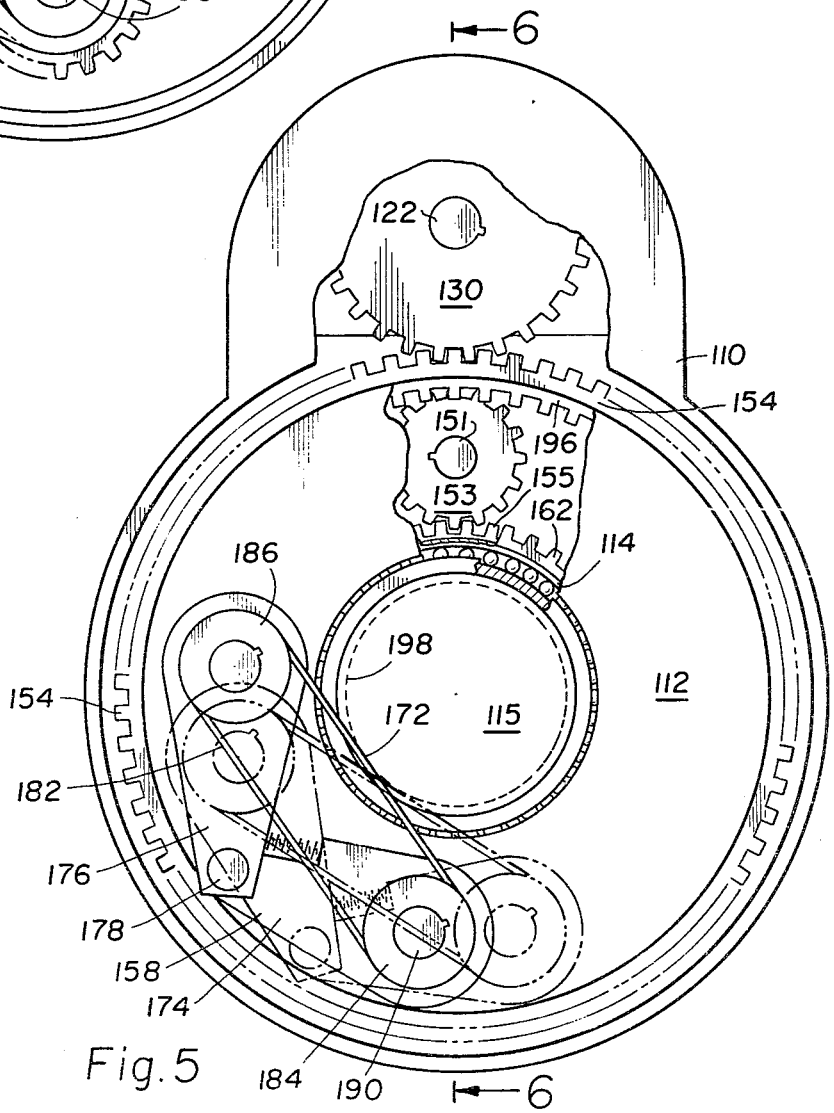
FIG. 5 is a partially cut away front elevation view of a second embodiment of the present invention.
Figure 6:
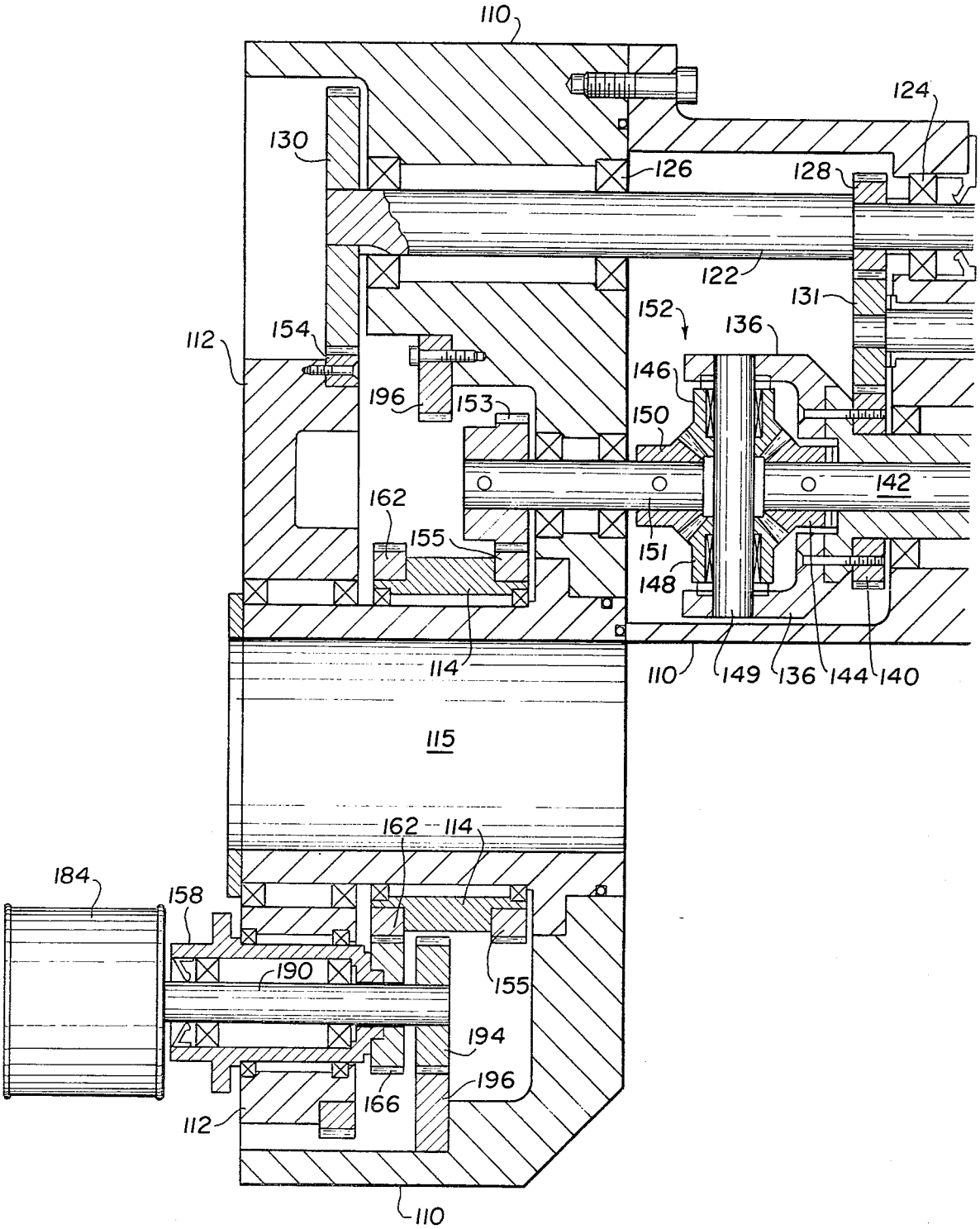
FIG. 6 is a sectional view taken along lines 6—6 of FIG. 5.

FIGS. 5 and 6 show a second preferred embodiment of the present invention in which the mounting wheel 112 and tracking means 114 are rotatably disposed about a central passageway 115 through the casing 110. The reader will observe that call out numbers in FIGS. 5 and 6 parallel those of FIGS. 1–4 except that they are prefixed by a "1". Also, since many of the elements of the second embodiment are identical to those already described, only the distinctions between the two embodiments are set out in detail below.

As seen in FIG. 6, drive shaft 122 carrying first and second drive gears 128 and 130 is supported by bearings 124 and 126. Idler gear 131 having a rotational axis parallel to those of the drive shaft 122 and the adjusting shaft 142 is rotatably mounted to casing 110 to mesh with first drive gear 128 and free gear 140 fixed to miter gear support 136.

Miter gear support 136 and adjusting shaft 142 rotatably disposed therein, are, as in the first embodiment, rotatable with respect to each other and casing 110 about a common axis parallel to the rotational axis of drive shaft 122. Also, mounting wheel 112 and tracking means 114 have rotational axes aligned with each other. However, the rotational axes of the mounting wheel 112 and tracking means 114, though parallel to, are not aligned with the common rotational axis of miter gear support 136 and adjusting shaft 142 as in the first embodiment. Rather, miter gear support 136, adjusting shaft 142, planetary miter gear arrangement 152, transfer shaft 151, and first transfer gear 153 are all offset from passageway 115 in which the rotational axes of the mounting wheel 112 and tracking means 114 are centered.

First miter gear 144 is fixed to adjusting shaft 142 and meshes with second and third miter gears 146 and 148. Second and third miter gears 146 and 148 are rotatably mounted to the miter gear support by means of a miter gear shaft 149 mounted in the miter gear support 136 such that the first miter gear 144 is located between miter gear shaft 149 and free gear 140. Fourth miter gear 150 is fixed to an end of transfer shaft 151 and meshes with second and third miter gears 146 and 148. Transfer shaft 151 is rotatably mounted to casing 110 such that its rotational axis is aligned with the rotational axis of the miter gear support. First transfer gear 153 is fixed to an end of the transfer shaft 151 opposite the fourth miter gear 150 to be rotatable therewith. Second transfer gear 155 is fixed to an end of tracking means or collar 114 to be rotatable therewith and mesh with the first transfer gear 153.

A mounting wheel gear 154 is fixed to the mounting wheel 112 to be rotatable therewith and mesh with second drive gear 130. As in the first embodiment, gear ratios are chosen such that mounting wheel 112 and the tracking means 114 are caused to rotate at an identical rotational velocity.

Pivot arm 158 is mounted to mounting wheel 112. Tracking gear 162 is fixed to collar 114 and meshes with pivot gear 166 fixed to pivot arm 158. It will be observed that since an outer shaft is not used in the second embodiment, tracking gear 162 and pivot gear 166 may be located behind mounting wheel 112.

As in the first embodiment, arm 158 may comprise first and second legs 174 and 176, pivotally joined at 178 and biased apart by spring 180, and abrasive belt 182 is positioned about drive wheel 184 and free wheel 186. Also, drive wheel 184 is fixed to belt shaft 190 rotatably disposed within first leg 174 of arm 158, free wheel 186 is rotatably mounted to second leg 176 of arm 158, and belt shaft gear 194 fixed to belt shaft 190 meshes with internal gear 196 mounted to casing 110.

B. Operation

Rotation of the drive shaft causes the mounting wheel and the tracking means to rotate at identical rotational velocities. In the first embodiment torque is transmitted from the first drive gear 28 to tracking means or inner shaft 14 by means of free gear 40 and planetary miter gear structure 52, and from the second drive gear 30 to mounting wheel 12 by means of mounting wheel gear 54 and outer shaft 18. In the second embodiment an additional idler gear 131 is inserted between the first drive gear 128 and free gear 140 to compensate for the rotational direction transposition occasioned by the addition of first and second gears 153 and 155.

Operation of the planetary miter gear structure is identical in both embodiments. The first miter gear, fixed to the adjusting shaft, acts as a stationary gear, and forces the second and third miter gears to rotate about their own axes as they are orbited about the first miter gear by the miter gear support. Both the orbital and rotational motions of the second and third miter gear add together to transmit torque to the fourth miter gear.

Handle 56 provides a means for causing an angular displacement of the tracking means with respect to the mounting wheel. Turning handle 56 causes rotation of the first miter gear which is transferred to the fourth miter gear by the rotational motion of the second and third miter gears about their own axes. In the first embodiment, the rotational displacement of fourth miter gear 50 directly affects tracking means or inner shaft 14, and the angular displacement of the tracking means with respect to mounting wheel 12 is translated to a pivotal motion of the arm 58 about its pivotal axis in the opposite direction of handle 56 by the action of tracking gear 62 on pivot gear 66. In the second embodiment, pivotal motion of arm 158 is in the same direction as the displacement of adjusting shaft 142 because of the transposition caused by transfer gears 153 and 155. The pivotal motion of the arm and abrader is illustrated by the ghost outline of pivot arm 58 in FIG. 4.

In both embodiments, rotation of the mounting wheel causes the pivot arm and abrader means to be orbited about the rotational axis of the mounting wheel. The orbital motion of the arm is translated to a rotational motion of the abrader by the action of the internal gear on the belt shaft gear, resulting in rotation of the drive wheel about its axis. The abrasive belt is held in tension by the spring biasing the first and second legs of the arm apart; thus, rotation of the drive wheel causes the abrasive belt to revolve synchronously with the free wheel and the drive wheel.

FIG. 5 shows the orbital path 198 traced out by operative portion 172 of abrasive belt 182 as abrader 170 orbits about the rotational axis of mounting wheel 112, with the orbital motion of the abrasive belt shown in ghost.

It is thus seen that an object centered around the rotational axis of the mounting wheel will be presented at its periphery with a rapidly moving abrasive belt which will evenly cover all points on the object's periphery as the operative portion of the abrasive belt is orbited by the mounting wheel. Further, the operative portion of the abrasive belt may be moved relative to the rotational axis of the mounting wheel by the pivotal motion of the arm to vary the diameter of the orbital path of the abrader during the operation of the machine. Also, the present invention, as manifested in the second embodiment described herein, may be used to finish both ends and lengths of objects, by feeding the object through central passageway 115, and, if desired, may be adapted for use with an automatic feed unit and/or automatic means for controlling the pivotal motion of the abrader.

Since these as well as other variations and modifications of the present invention will be apparent to one skilled in the art, the foregoing descriptions of preferred embodiments are presented by way of example only, and the scope of the invention is defined by the following appended claims.

What is claimed is:

1. A variable position orbital sanding head comprising:

a stationary casing;

a mounting wheel rotatably disposed about a passageway through the casing;

a tracking means rotatably disposed about the passageway through the casing such that a rotational axis of said tracking means is aligned with a rotational axis of the mounting wheel;

a transfer shaft rotatably mounted to the casing such that a rotational axis of said transfer shaft is offset from the rotational axes of the mounting wheel and tracking means;

a first transfer gear fixed to the transfer shaft to be rotatable therewith;

a second transfer gear fixed to the tracking means to be rotatable therewith, said second transfer gear meshing with the first transfer gear;

a free gear rotatably mounted to the casing to have a rotational axis coincidental with the rotational axis of the transfer shaft;

an idler gear rotatably mounted to the casing and meshing with the free gear;

a drive means for causing the mounting wheel and the idler gear to rotate;

coupling means for transferring torque from the free gear to the transfer shaft such that the drive means causes the tracking means to rotate at an identical rotational velocity with the mounting wheel;

a control means associated with the coupling means for causing an angular displacement of the tracking means with respect to the mounting wheel, said control means being offset from the rotational axes of the mounting wheel and tracking means whereby the passageway through the casing is unobstructed by said control means;

an arm pivotally mounted to the mounting wheel such that a pivotal axis of said arm is parallel to and spaced from the rotational axis of the mounting wheel;

a means for translating the angular displacement of the tracking means with respect to the mounting wheel to a pivotal motion of the arm about its pivotal axis; and an abrader means mounted on the arm and having an operative portion spaced from the arm's pivotal axis, whereby said operative portion of the abrader means is caused to move relative to the rotational axis of the mounting wheel by the pivotal motion of the arm, and objects to be operated on by the abrader means may be fed through the passageway.

2. The machine of claim 1 wherein the tracking means comprises a collar rotatably disposed about the passageway through the casing.

3. The machine of claim 1 wherein the arm comprises:

a first leg pivotally mounted to the mounting wheel such that the pivotal axis of the arm is a pivotal axis of said first leg;

a second leg pivotally joined to the first leg at a point spaced from the pivotal axis of the arm; and a means for biasing the first and second legs apart arcuately.

4. The machine of claim 3 wherein the abrader means comprises:

a belt shaft rotatably disposed within the first leg of the arm such that a rotational axis of said belt shaft is coincidental with the pivotal axis of the arm;

a drive wheel mounted to an end of the belt shaft to be rotatable therewith;

a free wheel rotatably mounted to the second leg such that a rotational axis of said free wheel is parallel to the rotational axis of the belt shaft and spaced from the point at which the first and second legs are pivotally joined; and a continuous abrasive belt positioned around the free wheel and the drive wheel such that said abrasive belt is held in tension by the biasing means and revolves synchronously with the free wheel and the drive wheel.

5. The machine of claim 4 which further comprises:

a belt shaft gear fixed to another end of the belt shaft to be rotatable therewith;

an internal gear mounted to the casing to mesh with the belt shaft gear whereby an orbital motion of the belt shaft about the rotational axis of the mounting wheel is translated to a rotational motion of the belt shaft about its own rotational axis and causes the abrasive belt to revolve synchronously with the free wheel and the drive wheel.

6. The machine of claim 1 in which the means for translating the angular displacement of the tracking means with respect to the mounting wheel to a pivotal motion of the arm about its pivotal axis comprises:

a tracking gear fixed to the tracking means to be rotatable therewith; and a pivot gear fixed to the arm to be pivotable therewith such that said pivot gear meshes with the tracking gear.

7. A variable position orbital sanding head comprising:

a stationary casing;

a mounting wheel rotatably disposed about a passageway through the casing;

tracking means rotatably disposed about the passageway through the casing such that a rotational axis of said tracking means is aligned with a rotational axis of the mounting wheel;

a drive shaft rotatably mounted to the casing such that a rotational axis of said drive shaft is parallel to and spaced from the rotational axes of the mounting wheel and tracking means;

first and second drive gears mounted on the drive shaft to be rotatable therewith;

a miter gear support rotatably mounted to the casing such that a rotational axis of said miter gear support is aligned with the rotational axes of the mounting wheel and the tracking means;

an idler gear rotatably mounted to the casing and meshing with the first drive gear;

a free gear mounted on the miter gear support to be rotatable therewith and meshing with the idler gear;

an adjusting shaft rotatably disposed within the miter gear support such that a rotational axis of said adjusting shaft is coincidental with the rotational axis of the miter gear support;

a first miter gear fixed to an end of the adjusting shaft to be rotatable therewith;

a miter gear shaft mounted on the miter gear support such that the first miter gear is located between said miter gear shaft and the free gear;

a second miter gear rotatably mounted at an end of the miter gear shaft so that the second miter gear has a rotational axis perpendicular to the rotational axis of the adjusting shaft, and further so that the second miter gear meshes with the first miter gear;

a third miter gear rotatably mounted at another end of the miter gear shaft so that a rotational axis of the third miter gear is aligned with the rotational axis of the second miter gear, and further so that the third miter gear meshes with the first miter gear;

a transfer shaft rotatably mounted to the casing such that a rotational axis of the transfer shaft is aligned with the rotational axis of the miter gear support;

a fourth miter gear fixed to an end of the transfer shaft to be rotatable therewith and meshing with the second and third miter gears;

a first transfer gear fixed to another end of the transfer shaft to be rotatable therewith;

a second transfer gear fixed to an end of the tracking means to be rotatable therewith and meshing with the first transfer gear;

a mounting wheel gear fixed to the mounting wheel to be rotatable therewith and meshing with the second drive gear;

control means for causing an angular displacement of the tracking means with respect to the mounting wheel, said control means being offset from the rotational axes of the mounting wheel and tracking means whereby the passageway is unobstructed by said control means;

an arm pivotally mounted to the mounting wheel such that a pivotal axis of said arm is parallel to and spaced from the rotational axis of the mounting wheel;

means for translating the angular displacement of the tracking means with respect to the mounting wheel to a pivotal motion of the arm about its pivotal axis; and abrader means mounted on the arm and having an operative portion spaced from the arm's pivotal axis, whereby the operative portion of said abrader means is caused to move relative to the rotational axis of the mounting wheel by the pivotal motion of the arm, and objects to be operated on by said abrader means may be fed through the passageway.

8. The machine of claim 7 wherein the means for causing an angular displacement of the tracking means with respect to the mounting wheel comprises a handle fixed to another end of the adjusting shaft whereby the adjusting shaft and the first miter gear may be rotated by turning said handle.

* * * * *